US006344429B2

(12) United States Patent
Pereira et al.

(10) Patent No.: US 6,344,429 B2
(45) Date of Patent: Feb. 5, 2002

(54) OIL SOLUBLE COKING ADDITIVE, AND METHOD FOR MAKING AND USING SAME

(75) Inventors: Pedro Pereira, San Antonio de los Altos; Jose Guitian, Miranda; Jose Cordova, Caracas; Ramon Salazar; Monsaris Pimentel, both of Los Teques; Alice Dupatrocinio, Caracas, all of (VE)

(73) Assignee: Intevep, S.A., Caracas (VE)

( * ) Notice: Subject to any disclaimer, the term of this patent is extended or adjusted under 35 U.S.C. 154(b) by 0 days.

(21) Appl. No.: 09/793,845

(22) Filed: Feb. 26, 2001

Related U.S. Application Data

(63) Continuation of application No. 09/315,109, filed on May 18, 1999, now Pat. No. 6,193,875, which is a division of application No. 09/071,271, filed on May 1, 1998, now Pat. No. 6,169,054, which is a continuation-in-part of application No. 08/838,834, filed on Apr. 11, 1997, now Pat. No. 5,885,441, which is a continuation-in-part of application No. 08/406,073, filed on Mar. 17, 1995, now Pat. No. 5,688,741.

(51) Int. Cl.[7] ..... B01J 31/04; C10G 9/00

(52) U.S. Cl. ..... 502/157; 502/152; 502/171; 208/126; 208/131

(58) Field of Search ..... 502/157, 152, 502/171; 208/126, 131, 130

(56) References Cited

U.S. PATENT DOCUMENTS

| | | | | | |
|---|---|---|---|---|---|
| 1,876,270 | A | * | 9/1932 | Zorn | 208/108 |
| 4,178,227 | A | * | 12/1979 | Metrailer et al. | 208/50 |
| 4,389,301 | A | * | 6/1983 | Dahlberg et al. | 208/59 |
| 4,400,262 | A | * | 8/1983 | Bearden, Jr. et al. | 208/8 R |
| 4,863,887 | A | * | 9/1989 | Ohtake et al. | 502/150 |
| 5,151,173 | A | * | 9/1992 | Vaughn et al. | 208/430 |
| 5,336,395 | A | * | 8/1994 | Pabst et al. | 208/403 |
| 5,622,616 | A | * | 4/1997 | Porter et al. | 208/108 |
| 6,043,182 | A | * | 3/2000 | Cordova et al. | 502/107 |

* cited by examiner

*Primary Examiner*—Bekir L. Yildirim
(74) *Attorney, Agent, or Firm*—Bachman & LaPointe, P.C

(57) ABSTRACT

A method for making an oil soluble coking process additive, includes the steps of: providing mixture of a metal salt in water wherein the metal salt contains a metal selected from the group consisting of alkali metals, alkaline earth metals and mixtures thereof; providing a heavy hydrocarbon; forming an emulsion of the mixture and the heavy hydrocarbon; heating the emulsion so as to react the metal salt with components of the heavy hydrocarbon so as to provide a treated hydrocarbon containing oil soluble organometallic compound, wherein the organometallic compound includes the metal and is stable at a temperature of at least about 300° C. The oil soluble additive and a process using same are also disclosed.

8 Claims, 2 Drawing Sheets

OIL SOLUBLE COKING ADDITIVE, AND METHOD FOR MAKING AND USING SAME

CROSS-REFERENCE TO RELATED APPLICATIONS

The instant application is a continuation of application Ser. No. 09/315,109 filed May 18, 1999; which in turn is a divisional of application Ser. No. 09/071,271 filed May 1, 1998, now U.S. Pat. No. 6,169,054 issued Jan. 2, 2001; which in turn is a continuation-in-part of application Ser. No. 08/838,834 filed Apr. 11, 1997, now U.S. Pat. No. 5,885,441 issued Mar. 23, 1999; which in turn is a continuation-in-part of application Ser. No. 08/406,073 filed Mar. 17, 1995, now U.S. Pat. No. 5,688,741 issued Nov. 18, 1997.

BACKGROUND OF THE INVENTION

The invention relates to coking processes for upgrading atmospheric and vacuum residues and, more particularly, to an oil soluble coking process additive, and method for making and using same, which reduces or minimizes coke formation and enhances desired distillation reactions.

Coking is an increasingly important process whereby heavy petroleum fractions such as atmospheric residue, vacuum residue, high-boiling virgin or cracked petroleum residue and the like are efficiently converted to more desirable distillate products, along with a by-product of coke.

A number of coking methods are known in the art. For example, U.S. Pat. No. 4,305,809 to Chen et al. discloses one such method, as does U.S. Pat. No. 4,756,819 to Bousquet et al.

Although conventional coking processes do provide for an upgraded distillate product, it is of course desirable to reduce the amount of by-product coke which is formed during such processes.

It is therefore the primary object of the present invention to provide a coking method whereby coke production is minimized and distillate production is enhanced.

It is a further object of the present invention to provide an oil soluble additive for coking process feedstock which minimizes or reduces flocculation and which shows catalytic activity toward distillate forming reactions.

It is still another object of the present invention to provide a method for preparing such an oil soluble additive from starting materials which are inexpensive and readily available.

Other objects and advantages of the present invention will appear hereinbelow.

SUMMARY OF THE INVENTION

In accordance with the present invention, the foregoing objects and advantages are readily attained.

According to the invention, a method is provided for making an oil soluble coking process additive, which method comprises the steps of: providing a mixture of a metal salt in water wherein the metal salt contains a metal selected from the group consisting of alkali metals, alkaline earth metals and mixtures thereof; providing a heavy hydrocarbon; forming an emulsion of said mixture and said heavy hydrocarbon; heating said emulsion so as to dehydrate said emulsion and react said metal salt with components of said heavy hydrocarbon so as to provide a treated hydrocarbon containing an oil soluble organometallic compound, wherein said organometallic compound includes said metal and is stable at a temperature of at least about 300° C.

In further accordance with the present invention, an additive for a coking feedstock is provided, which additive comprises: a hydrocarbon containing an oil soluble organometallic compound containing a metal selected from the group consisting of alkali metals, alkaline earth metals and mixtures thereof.

Still further in accordance with the present invention, a coking process is provided, which process comprises the steps of providing a heavy hydrocarbon feedstock containing an oil soluble organometallic compound containing a metal selected from the group consisting of alkali metals, alkaline earth metals and mixtures thereof; and subjecting said heavy hydrocarbon feedstock to coking conditions, whereby said organometallic compound acts as an anti-flocculent thereby minimizing coke formation.

BRIEF DESCRIPTION OF THE DRAWINGS

A detailed description of preferred embodiments of the invention follows, with reference to the attached drawings wherein.

DETAILED DESCRIPTION

Figure 1:
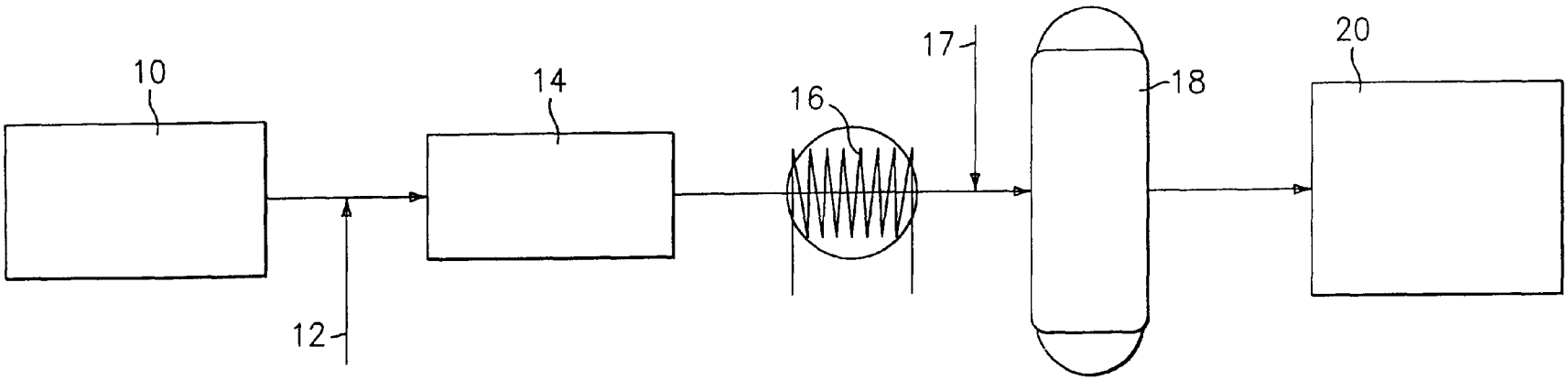
FIG. 1 schematically illustrates a method for making an oil soluble coking process additive in accordance with the present invention.

The invention relates to an oil soluble coking process additive for reducing or minimizing coke formation and enhancing distillate production in coking processes, especially delayed coking processes. The invention further relates to a method for making the oil soluble coking process additive, and a coking process utilizing the oil soluble coking process additive of the present invention.

According to the invention, an oil soluble additive is introduced into coking feedstocks in the form of an oil soluble organometallic compound which is stable up to certain elevated temperatures and which acts as an anti-flocculent so as to reduce or minimize coke formation during the coking process. Further, once decomposition temperature is reached, the compound does decompose, and the resulting metal is a catalyst toward desired distillate forming reactions which is useful, for example in steam conversion.

According to the invention, the oil soluble coking process additive is prepared by forming a mixture of a metal salt in water, and then forming an emulsion of the mixture with a heavy hydrocarbon feedstock to be treated, and subsequently heating the emulsion so as to dehydrate the emulsion and react the metal salt with components within the heavy hydrocarbon so as to provide a treated hydrocarbon containing an oil soluble organometallic compound.

Metal salts preferably include salts of alkali metals, alkaline earth metals and mixtures thereof. More preferably, the metal salt is a salt of potassium, calcium and mixtures thereof. Alkaline earth metals are preferred, and the metal is most preferably calcium. Suitable salts include hydroxides such as potassium hydroxide and calcium hydroxide, and carbonates such as calcium carbonate and the like. The most preferred salt is calcium hydroxide.

Suitable heavy hydrocarbon for use in preparing the additive in accordance with the present invention typically includes any suitable feed for a coking process, and preferably is an atmospheric or vacuum residue. As will be set forth in further detail below, the oil soluble additive of the present invention may suitably be introduced directly to the feedstock by treating the feedstock itself, or a portion of the feed can be separated from the main volume of feed and used to prepare the oil soluble additive contained therein, with this portion then being re-introduced into the main volume of the feed.

The mixture of metal salt in water may suitably be provided as a solution or dispersion, depending upon the water solubility of the metal salt.

Metal salt/water mixture or solution and heavy hydrocarbon are preferably mixed to form the emulsion having a ratio by volume of water to oil of between about 4:96 and about 40:80, more preferably, between about 5:95 and about 20:80.In addition, metal salt is preferably provided in the water mixture and the water mixture provided in amounts sufficient to provide for a concentration of metal in the final hydrocarbon feedstock of at least about 20 ppm wt. based upon the feed, preferably at least about 50 ppm wt. based upon the feed.

The emulsion is preferably formed in accordance with the present invention by providing the water mixture and hydrocarbon phases at a temperature of between about 50° C. and about 300° C., more preferably between about 100° C. and about 150° C., and forming the emulsion at a desired temperature, mixing rate and mixing time to provide a desired emulsion. The emulsion is preferably formed using sufficient energy to provide an average droplet size of the emulsion of less than or equal to about 1 micron. The emulsion is preferably formed at a temperature of between about 90° C. and about 300° C., and most preferably at a temperature of about 100° C., and may be formed using a mixing rate of between about 600 rpm and about 1200 rpm. Of course, other emulsion formation procedures can be used, if desired.

The emulsion is then preferably heated, as discussed above, and it is believed in accordance with the present invention that the heating step induces an interfacial reaction between heavy heteroatomic components or polar molecules of the crude, and salt cations/anions in the water phase so as to form a chemical association between the metal and hydrocarbon as desired. The reaction product of this step is an oil soluble compound which serves advantageously as an anti-flocculent as well as a catalyst precursor. The reaction product may be, for example, $CaNaph_2$, KNaph, $Ca(CH_3(CH_2)_{14}COO)_2$, $K(CH_3(CH_2)_{14}COO)$, $Ca(CH_3(CH_2)_4CH{=}CH(CH_2)_7COO)_2$, $K(CH_3(CH_2)_4CH{=}CH(CH_2)_7COO)$, and mixtures thereof, wherein Naph is naphthenate.

After the emulsion is formed, it is preferably heated to a temperature sufficient to react the metal salt with certain components of the heavy hydrocarbon so as to dehydrate the emulsion and to provide the desired oil soluble organometallic compound.

Typical heavy hydrocarbon for use in accordance with the present invention includes one or more compounds with which the metal salt can react to form the desired organometallic compound as a reaction product. These components of the heavy hydrocarbon include naphthenic acid, palmitic acid, oleic acid, and other organic acids or compositions which react with the metal salt to provide the desired organometallic compound which is preferably soluble in oil at temperatures above about 250° C., preferably above about 200° C., and is stable at temperatures of at least about 300° C., and more preferably at least about 450° C., as desired and as will be further discussed below.

Referring now to FIG. 1, a process in accordance with a preferred embodiment of the present invention is illustrated.

As shown, a suitable feed is provided, for example in the form of an atmospheric/vacuum residue at a temperature of about 100° C. To this residue 10, an aqueous dispersion 12 of metal salt is added, and this combination is passed to static mixer 14 wherein sufficient energy is applied to the mixture for a time sufficient to form a water-in-oil emulsion of the aqueous dispersion in the atmospheric/vacuum residue. This emulsion is then passed to a preheater 16 wherein the emulsion is heated to a temperature sufficient to dehydrate the emulsion and react the metal salt from the aqueous dispersion with components or acids from the heavy hydrocarbon as discussed above so as to provide the desired oil soluble organometallic compounds. Preheater 16 may suitably be used to heat this emulsion to a temperature of about 200° C.

At this point, the oil soluble coking process additive of the present invention is provided in the form of a treated hydrocarbon containing oil soluble organometallic compound in accordance with the present invention. It should of course be appreciated that this additive could alternatively be provided by separating off a portion of residue 10 for mixing with aqueous dispersion 12 and subsequent heating, and that this treated hydrocarbon can easily be re-introduced to the original feed to provide reaction feedstock which preferably includes the organometallic compound in amounts sufficient to provide a concentration of metal of at least about 20 ppm, preferably at least about 50 ppm.

As shown in FIG. 1, water 17 may suitably be injected into the reaction feedstock, if desired, preferably in amounts less than or equal to about 30% volume based on the original feedstock.

The reaction feedstock is then fed to a conventional coking process reactor where it is subjected to conventional coking conditions including a temperature which eventually exceeds the temperature at which the organometallic compound decomposes or is no longer stable. Typical process conditions include a temperature of about 460° C.–540° C., a pressure of about 15–30 psi and a residence time of about 24 hours.

In coking process reactor 18, the process is carried out during a first stage or phase wherein the oil soluble organometallic compound is still below its decomposition temperature, and the compound advantageously serves as an anti-flocculent, thereby reducing or minimizing polymerization reactions which lead to coke formation. Eventually, temperature to which the organometallic compound is exposed exceeds the decomposition temperature thereof, and the compound decomposes so as to provide the metal in the form of a catalyst for enhancing distillate formation reactions during a second phase or stage of the process, for example steam conversion.

As a result of the above, an end product 20 of the coking process advantageously contains enhanced distillate fractions and reduced coke fractions as desired in accordance with the present invention.

The following examples further illustrate the method and additive of present invention.

EXAMPLE 1

In this example, a feedstock was treated in a delayed coking process for four different runs using calcium, potassium, and a calcium/potassium mixture as additive. In addition, 1 run was conducted without an additive as a control (run 1).

The feed was heavy hydrocarbon having the following characteristics:

TABLE 1

| Characteristic of Vacuum Residue from Amuay Refinery (Feedstock) | |
|---|---|
| API Gravity | 4.7 |
| Penetration Index @ 77° F. | 15–16 |
| Kinematic Viscosity 260° C. | 377.5 |
| Sulfur, % wt | 2.99 |
| Conradson Carbon, % wt | 20.6 |
| Carbon, % wt | 81.41 |
| Hydrogen, % wt | 10.0 |
| Nitrogen, ppm | 7362 |
| SARA Distribution (TLC), % wt | |
| Saturated | 8.2 |
| Aromatic | 53.5 |
| Resin | 24.3 |
| Asphaltene | 14.1 |
| Metals, ppm | |
| Vanadium | 665 |
| Nickel | 90 |
| Iron | 7 |

In run 2, the feedstock was provided with a final concentration of calcium of 500 ppm. In run 3 the feedstock was provided with a final concentration of potassium of 500 ppm, and in run 4, the feedstock was provided with a final concentration of calcium and potassium in the amount of 500 ppm each.

The coking reaction was carried out at a pressure of one atmosphere, a temperature of 540° C. and water flow rate of 2 ml/min. The metal additive was prepared according to the invention to include the metals in the form of oil soluble naphthenate salts.

The results of these runs are set forth in Table 2 below.

TABLE 2

EFFECT OF THE CALCIUM AND POTASSIUM ORGANIC ADDITIVE ON COKING REACTIONS

| RUN | ADDITIVES | COKE | DISTILLATES | GASES | $H_2O$ (ml/min) |
|---|---|---|---|---|---|
| 1 | NONE | 26 | 62 | 12 | 2 |
| 2 | Ca(500 PPM) | 19 | 73 | 7 | 2 |
| 3 | K(550 PPM) | 22.5 | 69 | 8.0 | 2 |
| 4 | Ca/K (500/500 PPM) | 19.3 | 72 | 8.3 | 2 |
| 5 | NONE | 28 | 60 | 12 | 1 |
| 6 | Ca(20 PPM) | 26 | 62 | 12 | 1 |
| 7 | Ca(500 PPM) | 22 | 74 | 4 | 1 |

REACTION CONDITION: 1 ATM, 540° C.

As shown in Table 2, coke production was significantly reduced in each of runs 2, 3 and 4 as compared to run 1 which included no additive. In addition, distillate production was advantageously enhanced in each of runs 2, 3 and 4. The same is true with respect to runs 6 and 7 as compared to run 5.

EXAMPLE 2

In this example, feedstocks were prepared and treated in a delayed coking reaction starting with the same basic feedstock as set forth in Example 1 above. Three reaction feedstocks were prepared and tested in the delayed coking process. The first reaction feedstock was prepared without any additive. The second reaction feedstock was prepared containing the oil soluble reaction product of calcium and oleic acid sufficient to provide the feedstock with a calcium content of 50 ppm, and the third reaction feedstock was prepared containing the reaction product of calcium and naphthenic acid sufficient to provide the reaction feedstock with a calcium content of 500 ppm.

Figure 2:
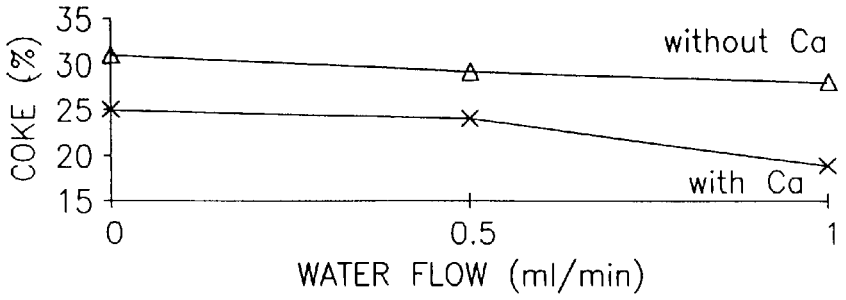
FIG. 2 illustrates the relation between coke yield and water flow for a feedstock treated with 50 ppm calcium additive and for a feedstock without any additive.
Figure 3:
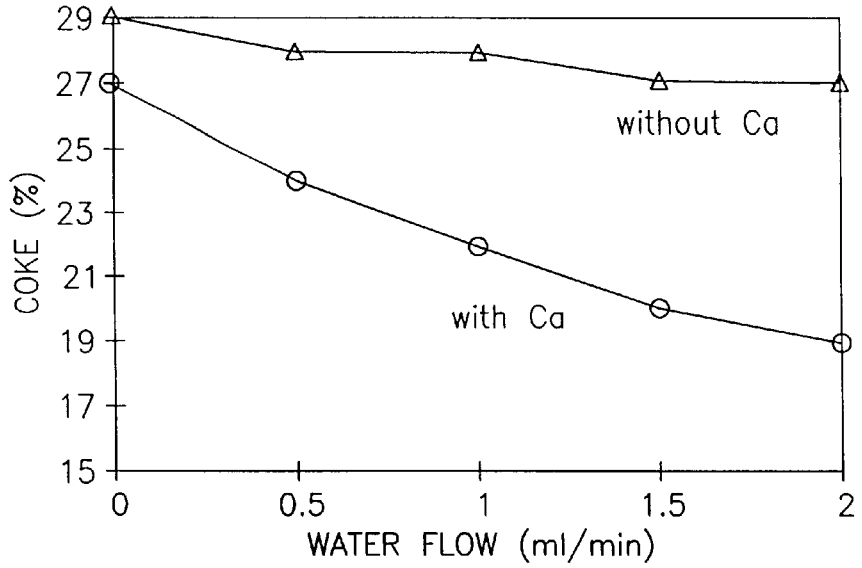
FIG. 3 illustrates the relation between coke yield and water flow for a feedstock treated with 500 ppm calcium additive and a feedstock without additive.
Figure 4:
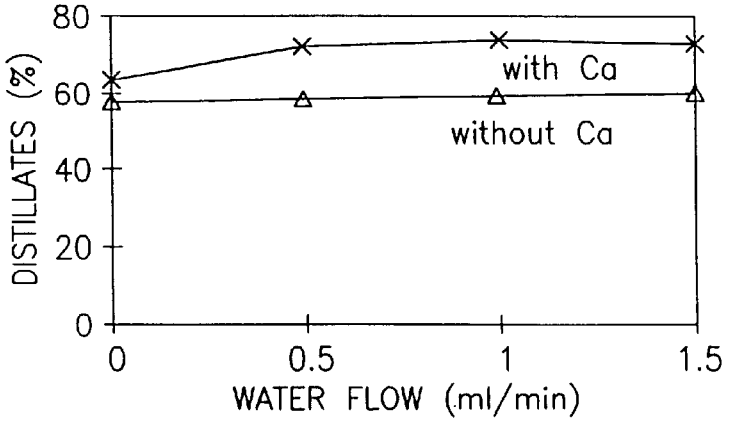
FIG. 4 illustrates the relation between distillate production and water flow in connection with a feedstock treated with 500 ppm calcium additive and a feedstock without additive.

Each of the three reaction feedstocks was treated at a temperature of 540° C. and a pressure of one atmosphere at varying water flow rates. The results of the process in terms of coke yield are illustrated in FIGS. 2 and 3. FIG. 2 comparatively illustrates the coke yield using the feedstock having no additive, as compared to coke yield using the feedstock including 50 ppm calcium. As shown, the coke yield is substantially reduced for the feedstock with additive. FIG. 3 shows the coke yield for the non-additive feedstock as compared to the feedstock treated with 500 ppm calcium, and again shows substantial reduction in coke yield with the additive of the present invention. As set forth above, the oil soluble additive in accordance with the present invention also advantageously provides for increase in liquid distillate yield. FIG. 4 illustrates the distillate yield for the reaction feedstock without additive as compared to the reaction feedstock containing 500 ppm calcium. As shown, significant increases in distillate yield were accomplished using the feedstock treated with additive in accordance with the present invention.

In accordance with the foregoing, it should readily be appreciated that an oil soluble additive has been provided for advantageously enhancing the results of coking processes such as delayed coking. The oil soluble additive of the present invention advantageously acts as an anti-flocculent prior to thermal decomposition during the coking process so as to inhibit early polymerization of coke precursors. Further, after decomposition of the oil soluble additive of the present invention, catalytic metals are dispersed through the feed which serve to enhance reactions toward distillate products as desired. Still further, the additive is provided using inexpensive and readily available starting materials, and further is provided in an oil soluble form thereby facilitating substantially homogenous dispersion of the additive through a feedstock to be treated.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

We claim:

1. An additive for a coking feedstock comprising: a hydrocarbon containing an oil soluble organometallic compound containing a metal selected from the group consisting of alkali metals, alkaline earth metals and mixtures thereof.

2. An additive according to claim 1, wherein said metal is selected from the group consisting of potassium, calcium and mixtures thereof.

3. An additive according to claim 1, wherein said metal is an alkaline earth metal.

4. An additive according to claim 1, wherein said metal is calcium.

5. An additive according to claim 1, wherein said organometallic compound is stable at a temperature of at least about 300° C.

6. An additive according to claim 1, wherein said organometallic compound is stable at a temperature of at least about 450° C.

7. An additive according to claim 1, wherein said organometallic compound comprises a reaction product of said metal and a compound selected from the group consisting of naphthenic acid, palmitic acid, oleic acid and mixtures thereof.

8. An additive according to claim 7, wherein said reaction product is selected from the group consisting of $CaNaph_2$, KNaph, $Ca(CH_3(CH_2)_{14}COO)2$, $K(CH_3\ (CH_2)_{14}COO)$, $Ca(CH_3\ (CH_2)_4CH{=}CH\ (CH_2)_7COO)_2$, $K(CH_3\ (CH_2)_4CH{=}CH(CH_2)_7COO)$, and mixtures thereof, wherein Naph is naphthenate.

* * * * *

UNITED STATES PATENT AND TRADEMARK OFFICE

CERTIFICATE OF CORRECTION

PATENT NO. : 6,344,429 B2 
DATED : February 5, 2002
INVENTOR(S) : Pedro Pereira et al.

It is certified that error appears in the above-identified patent and that said Letters Patent is hereby corrected as shown below:

Column 3,
Line 54, "$_4CH=CH(CH_{2)7}C00)_2$," should be corrected to read -- $_4CH=CH(CH_2)_7C00)_2$, --

Column 8,
Line 3, "$Ca(CH_3(CH_2)_{14}C00)2$, $K(CH_3(CH_2)_{14}C00)$," should be corrected to read
-- $Ca(CH_3(CH_2)_{14}C00)_2$, $K(CH_3(CH_2)_{14}COO)$, --

Signed and Sealed this

Twenty-eighth Day of January, 2003

JAMES E. ROGAN
*Director of the United States Patent and Trademark Office*